United States Patent [19]

Fortier

[11] Patent Number: 4,699,407

[45] Date of Patent: Oct. 13, 1987

[54] SLIDING DOOR AND WINDOW LOCKING DEVICE

[76] Inventor: Serge Fortier, 8752 rue de Grosbois, Apt. 1, Montreal, Canada, H2G 1B8

[21] Appl. No.: 799,810

[22] Filed: Nov. 20, 1985

[51] Int. Cl.[4] ..... E05C 17/34

[52] U.S. Cl. ..... 292/263; 292/DIG. 46

[58] Field of Search ..... 292/262, 263, 338, 339, 292/DIG. 46; 70/94; 403/108

[56] References Cited

U.S. PATENT DOCUMENTS

| | | | |
|---|---|---|---|
| 2,779,561 | 1/1957 | Blundeau | 403/108 X |
| 3,287,050 | 11/1966 | Ferrante | 292/262 X |
| 3,698,754 | 10/1972 | Means | 292/262 |
| 3,816,967 | 6/1974 | Littrell | 292/262 X |
| 4,056,115 | 11/1977 | Thomas | 403/108 X |
| 4,073,522 | 2/1978 | Tierney | 292/262 |
| 4,139,227 | 2/1979 | Spurr | 292/339 |
| 4,157,128 | 6/1979 | Peters | 292/339 X |
| 4,231,599 | 11/1980 | Gayman | 292/339 |
| 4,395,065 | 7/1983 | Nelson et al. | 292/339 |
| 4,493,501 | 1/1985 | Abel | 292/DIG. 46 X |

*Primary Examiner*—Richard E. Moore

*Attorney, Agent, or Firm*—Holman & Stern

[57] ABSTRACT

A locking device for sliding doors or windows comprises a pair of bars pivotally interconnected at an intermediate point on one of the bars to form a toggle mechanism. Pivotal movement is limited in one direction beyond the extended configuration of the bars, and friction pads are provided at their outer free ends for engaging opposing relatively movable surfaces of a sliding door or window unit. The device can be forceably locked in the extended configuration between the opposing surfaces by exerting pressure on the toggle mechanism.

4 Claims, 3 Drawing Figures

SLIDING DOOR AND WINDOW LOCKING DEVICE

This invention relates to a locking device for sliding doors or windows, such as sliding patio doors.

It has long been recognized that sliding patio doors constitute a security risk for the homeowner. They can only support flimsy locks and can be forced apart with relative ease by a burglar. There is sometimes sufficient vertical play in the doors to enable the burglar to disengage the catch simply by raising the door with a screwdriver or other device. Various security measures have been taken to combat this problem. Extra fittings can be added to the door, but usually this is difficult owing to the limited frame thickness and the fact that the frame is often made of metal. A common practice among homeowners is to place a bar of wood between the fixed and moveable frames, but firstly, the wood has to be cut to exactly the right size and secondly, it can often be dislodged by sliding a blade between the door and frame. Furthermore, a wooden bar is ineffective for use with double sliding doors.

An object of the invention is to provide a locking device that is simple in construction and yet capable of reliably securing sliding doors or windows.

According to the present invention there is provided a locking device for sliding doors or windows, comprising a pair of bar members, pivot means pivotally interconnecting said bar members at an intermediate point on one of said bar members to form a toggle mechanism, means for limiting pivotal movement in one direction beyond the extended configuration of the bar members, and friction pads at the outer free ends of the bar members for engaging opposing relatively movable surfaces of a sliding door or window unit, whereby said device can be forcibly locked in the extended configuration between said opposing surfaces by exerting pressure on the toggle mechanism.

In a prefered embodiment, one of the bar members has its inner end formed as a channel section receiving the other bar member. The channel section serves to limit pivitol movement of the bar members in the one direction beyond the extended configuration.

In order to make the device effective with double sliding doors or windows, a laterally projecting abutment can be fitted near the outer end of one of the bar members. The abutment will engage the frame of the other sliding door or window and thus prevent movement.

The toggle mechanism is extremely efficient at holding the opposing surfaces apart. It will generally exert a force in the order of 1,000 pounds on the surfaces. This force locks the sliding door or window quite firmly and makes it extremely difficult for a would-be burglar to dislodge the device.

The invention will now be explained in more detail, by way of example only, with reference to the accompanying drawings, in which.

Figure 1:
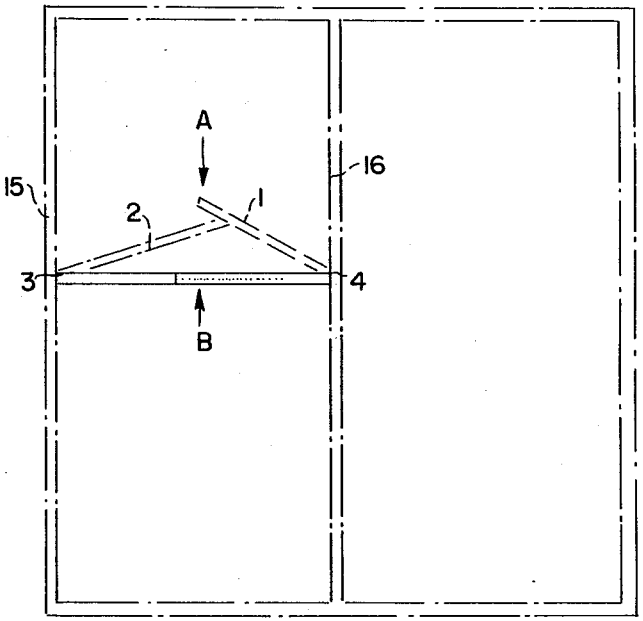
FIG. 1 is a front view, in schematic form, of a conventional patio door with a locking device in accordance with the invention installed.

In the drawings, the locking device comprises a pair of square-section bar members 1,2. Friction pads 3,4, covered in synthetic rubber material, are screwed into threaded bores in the outer free ends 5,6 of the bar members 1,2. Locking nuts 7,8 permit adjustment of the friction pads 3,4.

Figure 2:
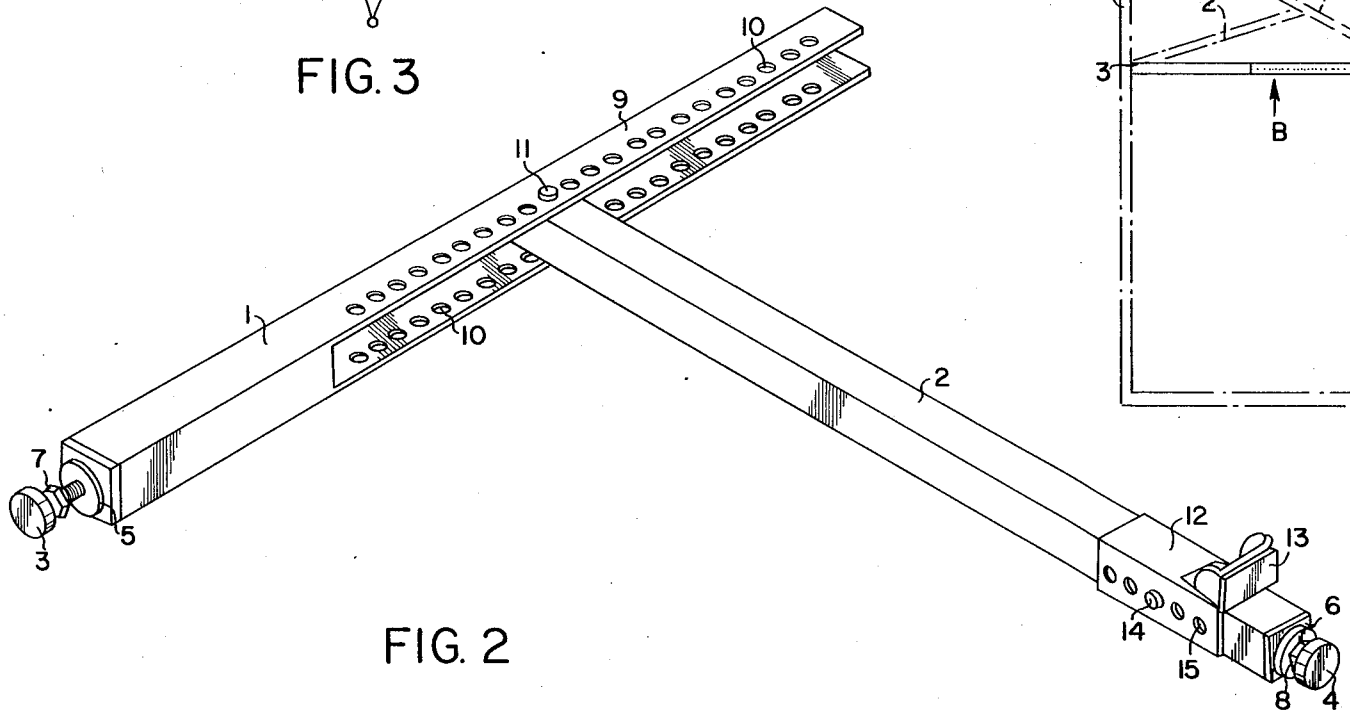
FIG. 2 is a perspective view of the locking device.
Figure 3:
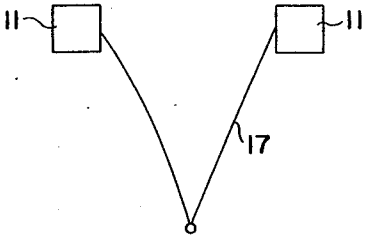
FIG. 3 illustrates the spring biased stub shafts.

The inner end of the bar member 1 is in the form of an open channel section 9 provided with a series of pairs of opposed holes 10 in its side walls. The inner end of the bar member 2 is received within the channel section 9 and pivotally connected thereto by means of a pair of stub shafts, of which one shaft 11 is visible in FIG. 2, engaged in one pair of the series of opposed holes 10. The stub shafts 11 are spring biased apart and extend through holes (not shown) in the side walls of the bar member 2. Preferably the bar member 2 is hollow, in which case the stub shafts 11 are connected to a V-shaped spring 17 inserted within the hollow member. The stub shaft pivotally interconnects the two bar members at a selected position determined by the location of the pair of opposed holes into which the stub shafts 11 are inserted. The bar members 1,2 can be pivoted freely in one direction, but are limited in the other direction as the channel section 10 receives the bar member 2.

A short channel section 12 carrying a lateral abutment 13 covered with synthetic rubber material is fitted over the outer end of the bar member 2. A spring biased pin 14 in the bar member 2 and a series of holes 15 in the channel section 12 enables the position of the channel section 12 to be adjusted.

To use the device, the user first adjusts the position of the friction pads and the pivot to the size of door or window. Coarse adjustment can be made by altering the position of the pivot point of the bar members and fine adjustment can be made by setting the position of the friction pads. In the case of a single sliding door or window the abutment 13 is not required. The user places the device between the fixed and moveable frame 15 and 16 respectively in FIG. 1, having set the device such that it takes on the configuration shown in dotted out line in FIG. 1. The arrangement of bar members 1,2 forms a toggle mechanism and as the user applies pressure in the direction of the arrow A, the outer ends of the device are urged apart with great force. The device will exert a force of approximately 1,000 pounds on the opposing fixed and moveable surfaces of the door or window unit. When the device reaches the straight, extended position, as shown in full outline in FIG. 1, it cannot pivot any further and self-locks in this configuration. The device can be designed so as to pivot slightly beyond the straight configuration before locking, but provided it is pivotted into the straight configuration or slightly beyond, it will self-lock. The device can then be released only applying upwards pressure in the direction of the arrow B. Longitudinal pressure will not, of course, release the device.

The high pressure exerted on the window frame holds it quite firmly and makes it difficult for the would-be burglar to move. It also makes it very difficult, if not impossible, for the burglar to dislodge the device by means of a blade or the like passed through the window frame.

Although simple in construction, the described device is an extremely effective means of securing sliding doors or windows, and in particular, patio doors.

In the case of double sliding doors or windows, that is the unit in which both doors or windows are slidable, the abutment 13 can be adjusted so that it comes up against the frame of the second sliding door or window. In this way, the device will effectively secure both sliding doors, something that is not possible with, for example, a simple wooden bar.

The embodiments of the invention in which an exlusive property or privilege is claimed are defined as follows:

1. A locking device for sliding doors or windows, comprising a pair of bar members, pivot means pivotally interconnecting said bar members at an intermediate point on one of said members to form a toggle mechanism, one of said bar members having an inner end portion in the form of an open channel receiving said other bar members and thereby inhibiting pivotal movement beyond the extended configuration of the bar members, said pivot means comprising a pair of stub shafts spring biased apart and selectively engageable in a pair of a series of opposed holes in said channel, and a friction pad adjustably mounted at each outer free end of the bar members for engaging opposing relatively movable surfaces of a sliding door or window unit, whereby said device can be forcibly locked in the extended configuration between said opposing surfaces by exerting pressure on the toggle mechanism and said device is retained in said extended configuration by the forced engagement of said friction pads against said relatively movable surfaces;

and further comprising in addition to said friction pads for engaging said opposing relatively movable surfaces a laterally projecting abutment near the outer end of one of the bar members, said abutment forming a shoulder to the side of said one bar member and being adjustable in position relative to said one bar member, for engaging a frame of a second sliding door or window, thereby to permit simultaneous locking of a double sliding door or window unit.

2. A locking device for sliding doors or windows as claimed in claim 1 wherein said abutment is covered in a synthetic rubber material.

3. A locking device for sliding doors or windows as claimed in claim 1 where said abutment is attached to a short channel section fitted over one of the bar members.

4. A locking device as claimed in claim 1 wherein said stub shafts are biased apart by means of a V spring.

* * * * *